US011564437B2

(12) United States Patent
Letendre

(10) Patent No.: US 11,564,437 B2
(45) Date of Patent: Jan. 31, 2023

(54) REMOVABLE CHIN CURTAIN ASSEMBLY SELECTIVELY ATTACHABLE TO A HELMET

(71) Applicant: BOMBARDIER RECREATIONAL PRODUCTS INC., Valcourt (CA)

(72) Inventor: Caroline Letendre, Drummondville (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 56 days.

(21) Appl. No.: 16/927,345

(22) Filed: Jul. 13, 2020

(65) Prior Publication Data

US 2021/0015196 A1 Jan. 21, 2021

Related U.S. Application Data

(60) Provisional application No. 62/876,357, filed on Jul. 19, 2019.

(51) Int. Cl.
*A42B 3/20* (2006.01)

(52) U.S. Cl.
CPC ..... *A42B 3/205* (2013.01)

(58) Field of Classification Search
CPC ..... A42B 3/222; A42B 3/221; A42B 3/223
USPC ..... 2/424
See application file for complete search history.

(56) References Cited

U.S. PATENT DOCUMENTS 5,575,009 A * 11/1996 Ryvin ..... A41D 13/1161 2/173
7,308,721 B1 * 12/2007 Rivera, Jr. ..... A41D 13/1153 2/9
8,201,276 B2 * 6/2012 Asta ..... A42B 3/105 2/205
8,555,418 B2 * 10/2013 Singh ..... A42B 1/0186 2/173
9,021,617 B2 5/2015 Asta
2015/0033455 A1 * 2/2015 Beauchamp ..... A42B 3/127 2/421
2015/0074879 A1 * 3/2015 Hillion ..... A42B 3/18 2/424

(Continued)

FOREIGN PATENT DOCUMENTS

EP 1949808 A2 7/2008
EP 3289905 B1 6/2019

OTHER PUBLICATIONS

NEKKR Installation, Dec. 11, 2016, retrieved from https://www.youtube.com/watch?v=ei8bOaDDSBM&t=1s on Sep. 14, 2021.

(Continued)

*Primary Examiner* — Timothy K Trieu
(74) *Attorney, Agent, or Firm* — BCF LLP

(57) ABSTRACT

A removable chin curtain assembly selectively attachable to a helmet is disclosed. The helmet has a helmet shell, a chin strap, and a pair of fasteners connecting the chin strap portion to the helmet shell. The fasteners are made at least in part of ferromagnetic material. The removable chin curtain assembly has a chin curtain and at least one permanent magnet connected to the chin curtain. The at least one permanent magnet is adapted for selectively magnetically connecting the chin curtain to at least one of the fasteners. Alternative embodiments of a removable chin curtain assembly are also disclosed.

24 Claims, 12 Drawing Sheets

(56) References Cited

U.S. PATENT DOCUMENTS

| | | | | |
|---|---|---|---|---|
| 2015/0245675 | A1* | 9/2015 | Chinquee | A61F 9/029 2/424 |
| 2016/0029734 | A1* | 2/2016 | Kurpjuweit | A42B 3/205 2/427 |
| 2019/0191811 | A1 | 6/2019 | Eley, Sr. | |
| 2021/0015196 | A1* | 1/2021 | Letendre | A42B 3/205 |

OTHER PUBLICATIONS

English translation of EP3289905B1 retrieved from https://patents.google.com/patent/EP3289905A1/en?oq=EP3289905 on Jul. 13, 2020.
Nekkr-Outlast the Wheather at Lest, retrieved from https://www.nekkr.com/instructions on Jul. 4, 2019.

* cited by examiner

REMOVABLE CHIN CURTAIN ASSEMBLY SELECTIVELY ATTACHABLE TO A HELMET

CROSS-REFERENCE

The present application claims priority to U.S. Provisional Patent Application No. 62/876,357, filed Jul. 19, 2019, the entirety of which is incorporated herein by reference.

FIELD OF TECHNOLOGY

The present technology relates to chin curtains that are selectively attachable to a helmet.

BACKGROUND

Helmets are a form protective equipment used to protect the head of a wearer. Helmets vary largely depending on their application. Indeed, there is a large array of activities that require head protection and so helmets are customized to best fit the activities' requirements. For instance, there are full face helmets, off-road helmets or open face helmets to name a few types of helmets.

For snowmobile riding, different types of helmets can be used depending on the type of riding being practiced. For touring, full face helmets are preferred as they fully cover the face of the wearer and thus help to keep the user's face warm. For snow-cross or backcountry snowmobile riding, which tends to be more active, helmets having a helmet shell and a jaw shield defining a space therebetween in front of the wearer's eyes are preferred. Wearers of these helmets will typically wear goggles, received in the space, to protect their eyes. These helmets have more ventilation openings than helmets used for touring in order to increase airflow. Indeed, snow-cross or backcountry snowmobile riding can be a high intensity activity, which may cause the rider to breathe heavily and require more oxygen and ventilation. These ventilation openings address this problem by allowing an increased circulation of fresh air around the rider's face while riding, compared to a full face helmet.

Although the ventilation provided by helmets used for snow-cross or backcountry snowmobile riding is helpful during active riding, this can cause the wearer's face to become cold when riding less actively, such as when riding to and from the snow-cross or backcountry snowmobile riding area or when using the helmet for touring, as some snowmobile riders may not have helmets adapted for every type of riding situations. The added ventilation can also lead to more dust entering the helmet.

Therefore, there is a desire for a device capable of reducing the amount of ventilation provided by helmets typically used for snow-cross or backcountry snowmobile riding to protect the wearers of such helmets from the cold and/or dust when riding less actively.

Similar helmets are also used for other activities such as motocross riding. As these activities can also be practiced in cold-weather conditions, they have similar problems. As there is also a desire for a similar device for these helmets.

SUMMARY

It is an object of the present technology to ameliorate at least some of the inconveniences present in the prior art.

According to one aspect of the present technology, there is provided a removable chin curtain assembly selectively attachable to a helmet. The helmet has: a helmet shell for receiving a head of a wearer of the helmet, the helmet shell defining at least in part an aperture, the wearer of the helmet seeing through the aperture when wearing the helmet; a chin strap connected to the helmet shell, the chin strap having a first chin strap portion and a second chin strap portion, the first chin strap portion being selectively connected to the second chin strap portion; a first fastener connecting the first chin strap portion to the helmet shell on a first side of the helmet, the first fastener being made at least in part of ferromagnetic material; and a second fastener connecting the second chin strap portion to the helmet shell on a second side of the helmet, the second fastener being made at least in part of ferromagnetic material. The removable chin curtain assembly has: a chin curtain; and at least one permanent magnet connected to the chin curtain, the at least one permanent magnet being adapted for selectively magnetically connecting the chin curtain to at least one of the first and second fasteners.

In some embodiments, the helmet further has a jaw shield connected to helmet shell. The helmet shell and the jaw shield define the aperture therebetween. The chin strap is fastened to at least one of the helmet shell and the jaw shield. The first fastener fastens the first chin strap portion to the at least one of the helmet shell and the jaw shield on the first side of the helmet. The second fastener fastens the second chin strap portion to the at least one of the helmet shell and the jaw shield on the second side of the helmet. The chin curtain, when connected to the helmet by the at least one permanent magnet, covers at least in part the jaw shield and extends below the jaw shield.

In some embodiments, the jaw shield defines at least one vent. The chin curtain, when connected to the helmet by the at least one permanent magnet, covers the at least one vent defined in the jaw shield.

In some embodiments, the at least one permanent magnet includes a first permanent magnet and a second permanent magnet. The first permanent magnet is adapted for selectively magnetically connecting the chin curtain to the first fastener. The second permanent magnet is adapted for selectively magnetically connecting the chin curtain to the second fastener.

In some embodiments, the chin curtain includes at least one pocket. The at least one permanent magnet is received in the at least one pocket.

In some embodiments, the at least one permanent magnet includes a first permanent magnet and a second permanent magnet. The first permanent magnet is adapted for selectively magnetically connecting the chin curtain to the first fastener. The second permanent magnet is adapted for selectively magnetically connecting the chin curtain to the second fastener. The at least one pocket includes a first plurality of pockets on a first side of the chin curtain and a second plurality of pockets on a second side of the chin curtain. The first permanent magnet is received in one pocket of the first plurality of pockets. The second permanent magnet is received in one pocket of the second plurality of pockets.

In some embodiments, the chin curtain is made from flexible material.

In some embodiments, the flexible material is at least one of: polyester fabric; and nylon coated with polyurethane.

In some embodiments, the chin curtain, when connected to the helmet by the at least one permanent magnet, extends over a top of the jaw shield to cover a generally U-shaped space defined by the jaw shield.

In some embodiments, the first and second permanent magnets are connected to first and second corner portions of the chin curtain. The first and second corner portions are disposed on opposite sides of the chin curtain.

In some embodiments, the chin curtain includes a first side portion and a second side portion. The first side portion is connected to the second side portion along a seam.

In some embodiments, the helmet further has a jaw shield connected to helmet shell. The helmet shell and the jaw shield define the aperture therebetween. The seam has an arcuate section defining a jaw shield receiving portion of the chin curtain, the jaw shield being received at least in part in the jaw shield receiving portion when the chin curtain is connected to the helmet by the at least one permanent magnet.

According to another aspect of the present technology, there is provided a helmet assembly having a helmet and a chin curtain assembly. The helmet has: a helmet shell for receiving a head of a wearer of the helmet; the helmet shell defining at least in part an aperture, the wearer of the helmet seeing through the aperture when wearing the helmet; a chin strap connected to the helmet shell, the chin strap having a first chin strap portion and a second chin strap portion, the first chin strap portion being selectively connected to the second chin strap portion; a first fastener connecting the first chin strap portion to the helmet shell on a first side of the helmet, the first fastener being made at least in part of ferromagnetic material; and a second fastener connecting the second chin strap portion to the helmet shell on a second side of the helmet, the second fastener being made at least in part of ferromagnetic material. The chin curtain assembly is selectively attachable to the helmet. The chin curtain assembly has: a chin curtain; and at least one permanent magnet connected to the chin curtain, the at least one permanent magnet selectively magnetically connecting the chin curtain to at least one of the first and second fasteners.

In some embodiments, the helmet further comprises a jaw shield connected to helmet shell. The helmet shell and the jaw shield define the aperture therebetween. The chin strap is fastened to at least one of the helmet shell and the jaw shield. The first fastener fastens the first chin strap portion to the at least one of the helmet shell and the jaw shield on the first side of the helmet. The second fastener fastens the second chin strap portion to the at least one of the helmet shell and the jaw shield on the second side of the helmet. The chin curtain, when connected to the helmet by the at least one permanent magnet, covers at least in part the jaw shield and extends below the jaw shield.

In some embodiments, the jaw shield defines at least one vent. The chin curtain, when connected to the helmet by the at least one permanent magnet, covers the at least one vent defined in the jaw shield.

In some embodiments, the first fastener has a first fastener head. The first fastener head is made of the ferromagnetic material. The first fastener head is disposed on an exterior of the helmet. The second fastener has a second fastener head. The second fastener head is made of the ferromagnetic material. The second fastener head is disposed on the exterior of the helmet. The at least one permanent magnet selectively magnetically connects the chin curtain to at least one of the first and second fastener heads.

In some embodiments, the at least one permanent magnet includes a first permanent magnet and a second permanent magnet. The first permanent magnet selectively magnetically connects the chin curtain to the first fastener. The second permanent magnet selectively magnetically connects the chin curtain to the second fastener.

In some embodiments, the chin curtain includes at least one pocket, the at least one permanent magnet being received in the at least one pocket.

In some embodiments, the chin curtain is made from flexible material.

In some embodiments, the flexible material is at least one of: polyester fabric; and nylon coated with polyurethane.

In some embodiments, the chin curtain, when connected to the helmet by the at least one permanent magnet, extends over a top of the jaw shield to cover a generally U-shaped space defined by the jaw shield.

In some embodiments, the first and second permanent magnets are connected to first and second corner portions of the chin curtain. The first and second corner portions are disposed on opposite sides of the chin curtain.

In some embodiments, the chin curtain includes a first side portion and a second side portion. The first side portion is connected to the second side portion along a seam.

In some embodiments, the helmet further has a jaw shield connected to helmet shell. The helmet shell and the jaw shield define the aperture therebetween. The seam has an arcuate section defining a jaw shield receiving portion of the chin curtain, the jaw shield being received at least in part in the jaw shield receiving portion when the chin curtain is connected to the helmet by the at least one permanent magnet.

According to another aspect of the present technology, there is provided a removable chin curtain assembly selectively attachable to a helmet. The helmet has: a helmet shell for receiving a head of a wearer of the helmet; the helmet shell defining at least in part an aperture, the wearer of the helmet seeing through the aperture when wearing the helmet; one of a first ferromagnetic connector and a first permanent magnet connected to a first side of the helmet; and one of a second ferromagnetic connector and a second permanent magnet connected to a second side of the helmet. The removable chin curtain assembly has: a chin curtain; an other one of the first ferromagnetic connector and the first permanent magnet connected to the chin curtain, the other one of the first ferromagnetic connector and the first permanent magnet being adapted for selectively magnetically connecting the chin curtain to the one of the first ferromagnetic connector and the first permanent magnet; and an other one of the second ferromagnetic connector and the second permanent magnet connected to the chin curtain, the other one of the second ferromagnetic connector and the second permanent magnet being adapted for selectively magnetically connecting the chin curtain to the one of the second ferromagnetic connector and the second permanent magnet.

In some embodiments, the helmet also has a jaw shield connected to the helmet shell. The helmet shell and the jaw shield define the aperture therebetween. The chin curtain, when connected to the helmet, covers at least in part the jaw shield and extends below the jaw shield.

In some embodiments, the jaw shield defines at least one vent. The chin curtain, when connected to the helmet by the at least one permanent magnet, covers the at least one vent defined in the jaw shield.

In some embodiments, the other one of the first ferromagnetic connector and the first permanent magnet is the first permanent magnet. The other one of the second ferromagnetic connector and the second permanent magnet is the second permanent magnet.

In some embodiments, the chin curtain includes at least one first pocket on a first side of the chin curtain and at least one second pocket on a second side of the chin curtain. The first permanent magnet is received in the at least one first pocket. The second permanent magnet is received in the at least one second pocket.

In some embodiments, the at least one first pocket is a first plurality of pockets. The at least one second pocket is a second plurality of pockets. The first permanent magnet is received in one pocket of the first plurality of pockets. The second permanent magnet is received in one pocket of the second plurality of pockets.

In some embodiments, the chin curtain is made from flexible material.

In some embodiments, the flexible material is at least one of: polyester fabric; and nylon coated with polyurethane.

In some embodiments, the chin curtain, when connected to the helmet by the at least one permanent magnet, extends over the jaw shield to cover a generally U-shaped space defined by the jaw shield.

In some embodiments, the first and second permanent magnets are connected to first and second corner portions of the chin curtain. The first and second corner portions are disposed on opposite sides of the chin curtain.

In some embodiments, the chin curtain includes a first side portion and a second side portion. The first side portion is connected to the second side portion along a seam.

In some embodiments, the helmet further comprises a jaw shield connected to helmet shell. The helmet shell and the jaw shield define the aperture therebetween. The seam has an arcuate section defining a jaw shield receiving portion of the chin curtain, the jaw shield being received at least in part in the jaw shield receiving portion when the chin curtain is connected to the helmet by the at least one permanent magnet.

According to another aspect of the present technology, there is provided a removable chin curtain assembly selectively attachable to a helmet. The helmet has: a helmet shell for receiving a head of a wearer of the helmet; a jaw shield connected to helmet shell, the jaw shield defining at least one vent, the helmet shell and the jaw shield defining an aperture therebetween, the wearer of the helmet seeing through the aperture when wearing the helmet; a first helmet connector disposed on a first side of the helmet; and a second helmet connector disposed on a second side of the helmet. The removable chin curtain assembly has: a chin curtain; a first chin curtain connector connected to the chin curtain, first chin curtain connector being adapted for removably connecting the chin curtain to the first helmet connector; and a second chin curtain connector connected to the chin curtain, second chin curtain connector being adapted for removably connecting the chin curtain to the second helmet connector. The chin curtain, when connected to the helmet: covers the at least one vent defined in the jaw shield; extends over a top of the jaw shield to cover a generally U-shaped space defined by the jaw shield; and extends below the jaw shield.

In some embodiments, the chin curtain is made from flexible material.

In some embodiments, the flexible material is at least one of: polyester fabric; and nylon coated with polyurethane.

In some embodiments, the first and second chin curtain connectors are connected to first and second corner portions of the chin curtain. The first and second corner portions are disposed on opposite sides of the chin curtain.

In some embodiments, the chin curtain includes a first side portion and a second side portion. The first side portion is connected to the second side portion along a seam.

In some embodiments, the seam has an arcuate section defining a jaw shield receiving portion of the chin curtain. The jaw shield is received at least in part in the jaw shield receiving portion when the chin curtain is connected to the helmet by the at least one permanent magnet.

In some embodiments, the chin curtain defines a jaw shield receiving portion in the form of a recess in the chin curtain. The jaw shield is received at least in part in the jaw shield receiving portion when the chin curtain is connected to the helmet.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
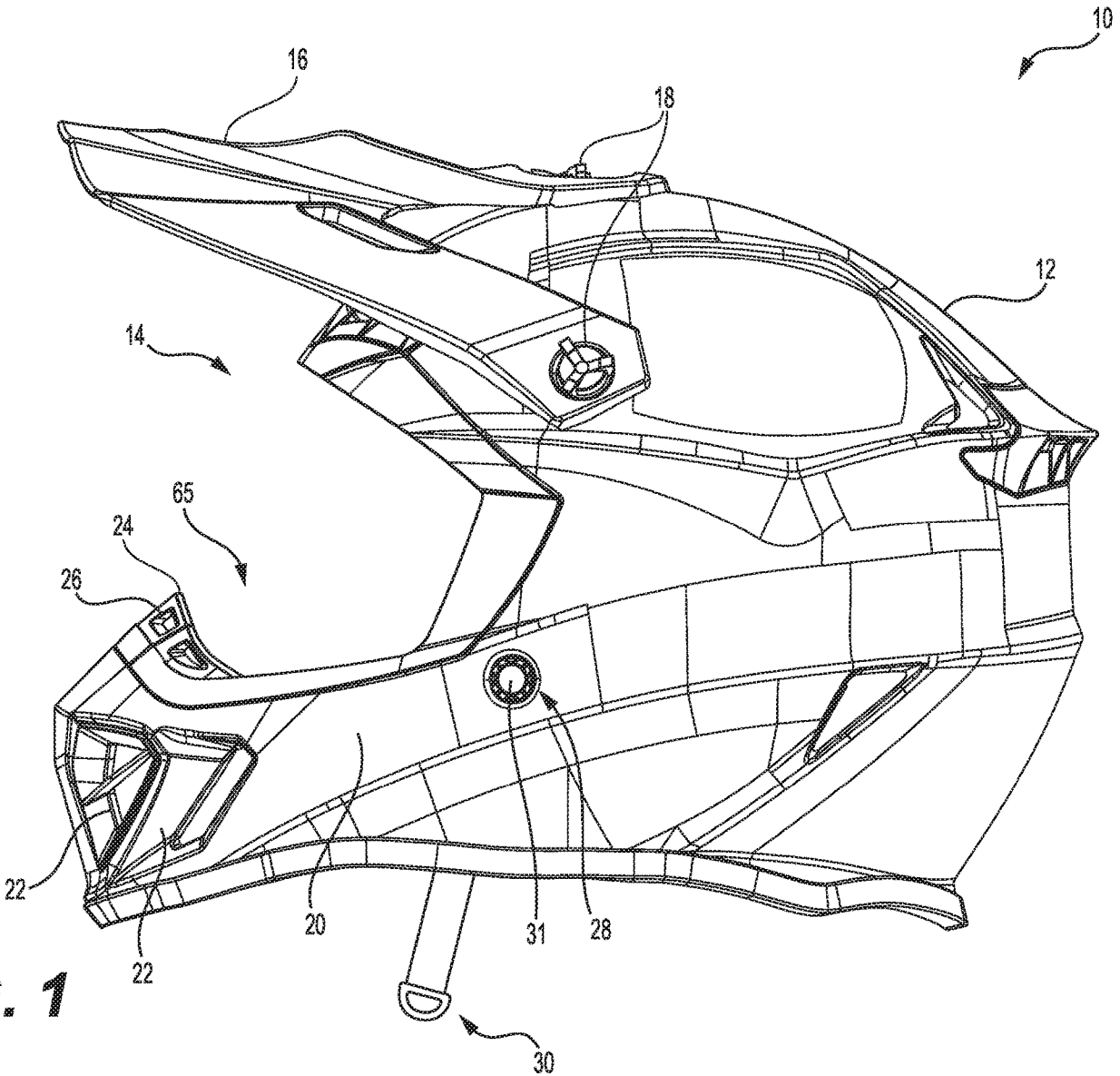
FIG. 1 is a left side elevation view of a helmet.
Figure 2:
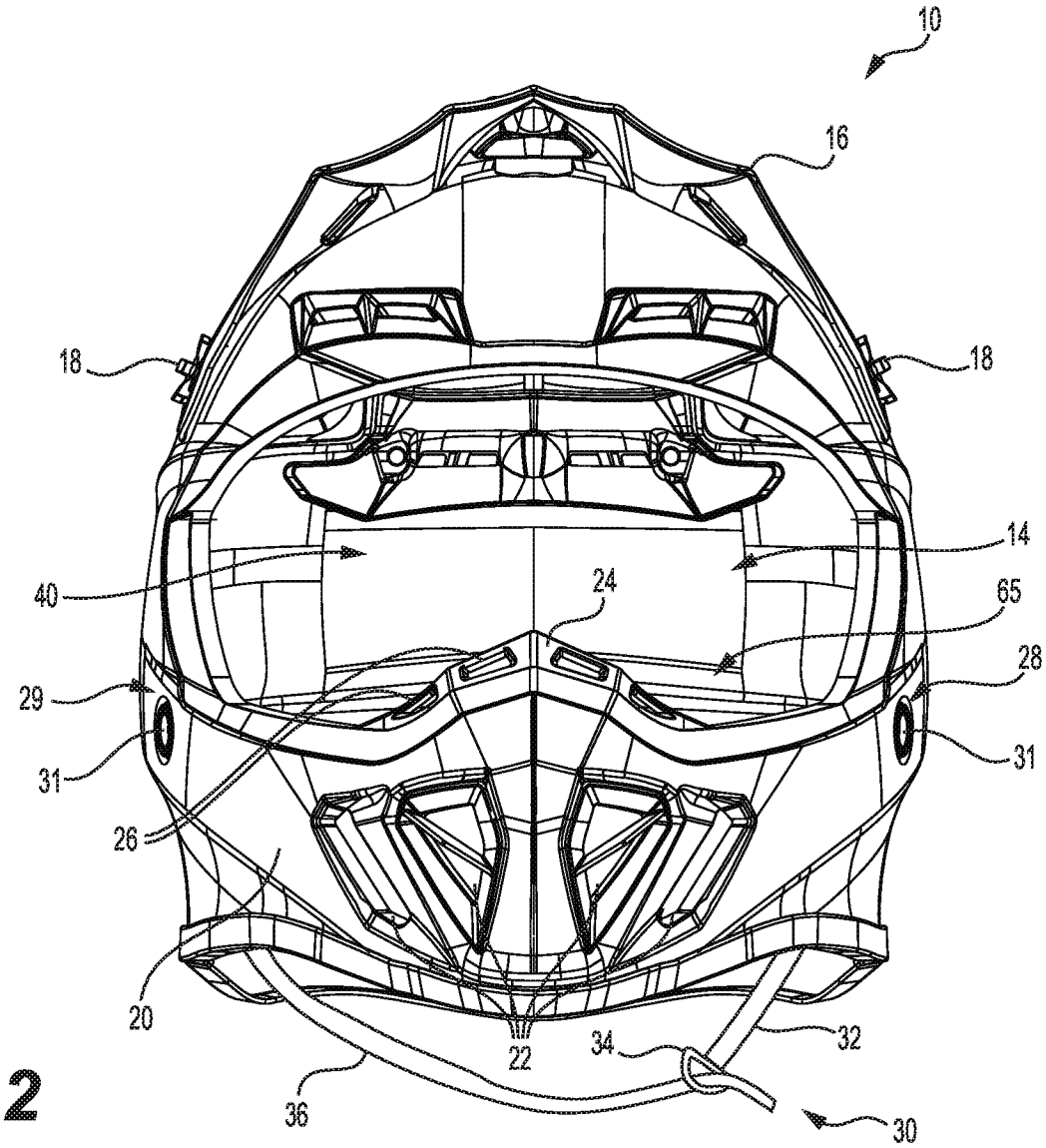
FIG. 2 is a front elevation view of the helmet of FIG. 1.
Figure 3:
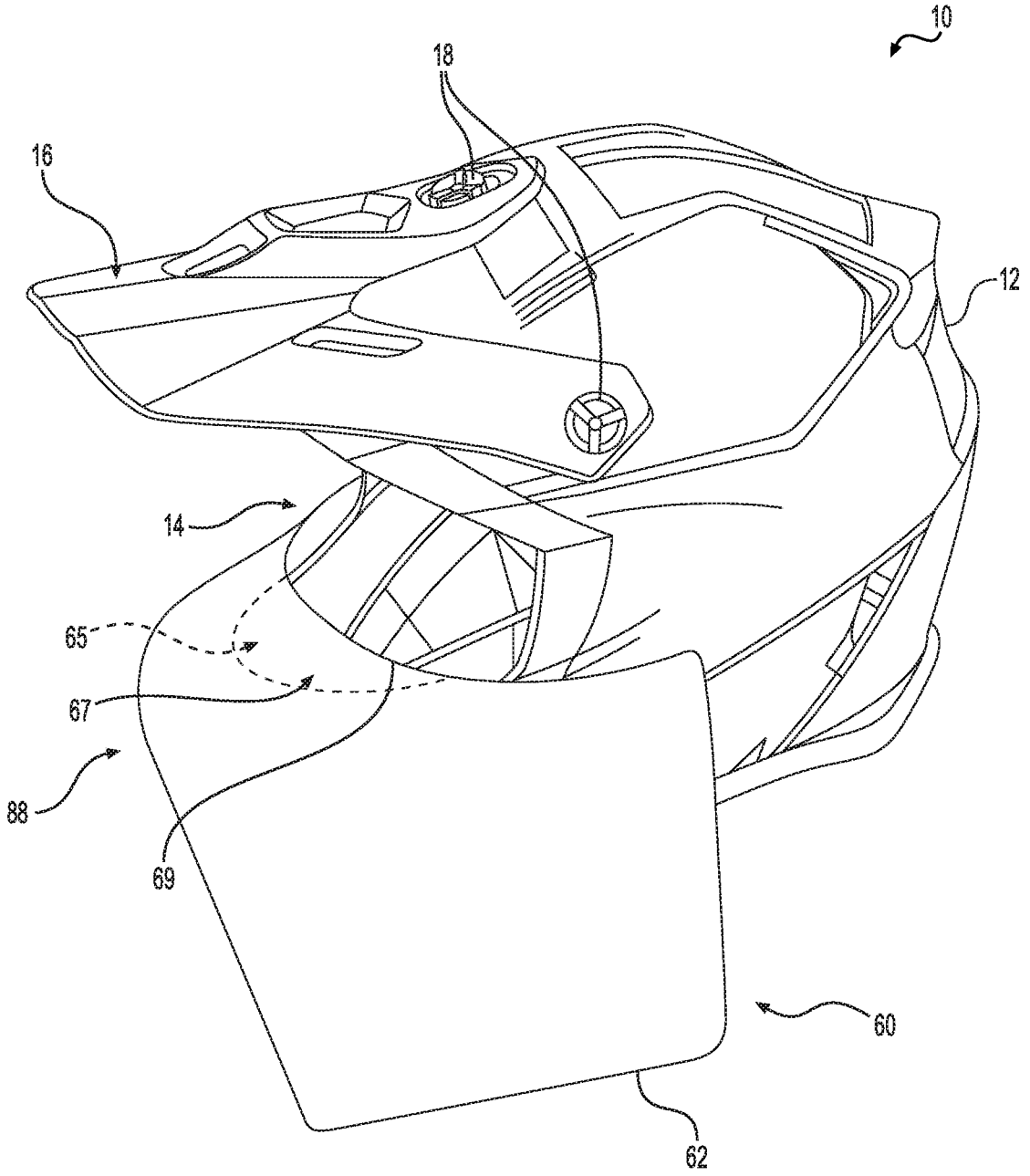
FIG. 3 is a perspective view taken from a front, left side of the helmet of FIG. 1 with a removable chin curtain assembly attached to the helmet.

As can be seen in FIGS. 1 and 2, a helmet 10 used to protect a head of a wearer includes a helmet shell 12 and a jaw shield 20 connected to a lower part of the helmet shell 12. In the present embodiment, the jaw shield 20 is integrally formed with the helmet shell 12, but it is contemplated that it could be connected to the helmet shell 12 in other ways. The helmet shell 12 defines an inner volume 40 adapted for receiving the head of the wearer of the helmet 10. The jaw shield 20 is positioned and shaped to extend in front of and shield the jaw area of the wearer of the helmet 10, as its name suggest. An aperture 14, defined by the helmet shell 12 and the jaw shield 20, which extends symmetrically in both lateral directions from the middle of the helmet 10, allows the wearer of the helmet 10 to see therethrough. A visor 16 is mounted to the helmet shell 12 above the aperture 14 using three visor fasteners 18. In alternative embodiments, the visor 16 may be pivotable with respect to the helmet shell 12, or may be omitted.

The jaw shield 20 defines four generally forwardly facing vents 22. The vents 22 are located near the front of the jaw shield 20. It is contemplated that the jaw shield 20 could define more or less than four vents 22. It is also contemplated that the vents 22 could be sized and/or shaped and/or positioned differently than illustrated. It is also contemplated that the jaw shield 20 could not define any vents 22. A nose guard 24 is connected to the upper, front portion of the jaw shield 20. The nose guard 24 defines four smaller generally forwardly facing vents 26. It is contemplated that the nose guard 24 could define more or less than four vents 26. It is also contemplated that the nose guard 24 could not define any vents 26. The vents 22 and 26 permit a flow of air to the inside the helmet 10 to cool the head of the wearer of the helmet 10.

As best seen in FIG. 2, the helmet 10 has a chin strap 30. The chin strap 30 is designed to extend under the chin of the wearer of the helmet 10 to secure the helmet 10 to the head of the wearer. The chin strap 30 has two chin strap portions 32 and 36. The left chin strap portion 32 is connected to the left side of the helmet shell 12 by a left side fastener 28. The right chin strap portion 36 is connected to right side of the helmet shell 12 by a right side fastener 29. D-rings 34 are connected to the extremity of the left chin strap portion 32. The right chin strap portion 36 is connected to the left chin strap portion 36 via the D-rings 34, which permits proper adjustment of the chin strap 30. It is contemplated that in alternative embodiments, the D-rings 34 could be replaced by another type of connector such as a clip for example.

The fasteners 28, 29 extend through the helmet shell 12, behind the jaw shield 20. In alternative embodiments, it is contemplated that the fasteners 28, 29 could be located at other suitable locations on the helmet 10, such as on the left and right rear portions of the jaw shield 20. In such an embodiment, the chin strap portions 32, 36 are connected to the helmet shell 12 via the jaw shield 20. As can be seen, the fastener heads 31 of the fasteners 28, 29 are disposed on the exterior of the helmet shell 12. As such, the fastener heads 31 are visible and accessible from outside of the helmet 10. In some embodiments, it is contemplated that the fastener heads 31 could be covered by parts of the helmet shell 12 itself or plugs disposed over the fastener heads 31. The fasteners 28, 29 are made of ferromagnetic material. In the present embodiment, the fasteners 28, 29 are made of steel, but other ferromagnetic materials are contemplated. It is contemplated that only the fastener heads 31 or parts of the fastener heads 31 could be made of ferromagnetic material and that the other portions of the fasteners 28, 29 could be made of another material.

With reference to FIGS. 3 to 6, a removable chin curtain assembly 60 can be selectively attached to the helmet 10. The chin curtain assembly 60 includes a chin curtain 62 and two permanent magnets 64, 66. When the chin curtain 62 is connected to the helmet 10 by the permanent magnets 64, 66 as shown and as will be described in more detail below, the chin curtain 62 covers the jaw shield 20, and therefore the vents 22, 26 and extends below the jaw shield 20. In addition, when the chin curtain 62 is connected to the helmet 10 by the magnets 64, 66, an upper portion 67 of the chin curtain 62 extends over a top of the jaw shield 20 to cover the U-shaped space 65 defined by the jaw shield 20. As a result, there is less airflow inside the helmet 10, thus keeping the head of the wearer of the helmet 10 warmer when not actively riding or when the weather is especially cold. It is contemplated that in some embodiments not the entire jaw shield 20 would be covered by the chin curtain 62, but at least the portion of the jaw shield 20 defining the vents 22 would be. It is also contemplated that in some embodiments the chin curtain 62 would not extend over the top of the jaw shield 20 and would therefore not cover the U-shaped space 65. It is also contemplated that the chin curtain 62 could be sized differently so as to extend higher or lower than shown below the jaw shield 20.

The chin curtain 62 is made of a flexible material. This material in some embodiments is additionally lightweight and prevents the passage of wind therethrough. In the present embodiment, the chin curtain is made of nylon coated with polyurethane. Another contemplated flexible material is polyester fabric. Other flexible materials are contemplated. By making the chin curtain 62 from flexible material, the chin curtain assembly 60, when not in use, can be folded and placed inside a jacket pocket, a storage compartment of the vehicle or any other convenient location.

The permanent magnets 64 and 66 are connected to left and right upper corner portions of the chin curtain 62 respectively. To connect the chin curtain assembly 60 to the helmet 10, the magnet 64 is placed on the head 31 of the left fastener 28 and the magnet 66 is placed on the head 31 of the right fastener 29, thereby magnetically connecting the chin curtain 62 to the helmet 10. The use of magnets 64, 66 also allows the chin curtain 62 to be reversed and connected to the helmet 10. For example, the chin curtain 62 could have one color and/or pattern on one side and another color and/or pattern on the other side, and the magnets 64, 66 allow the user to attach the chin curtain 62 with either side facing outwardly. To remove the chin curtain assembly 60, one simply has to pull on the chin curtain 62 until the magnets 64, 66 detach from the fasteners 28, 29. This can be easily achieved even when wearing gloves or mitts. In alternative embodiments, the chin curtain assembly 60 only has one of the magnets 64, 66, and the other corner portion of the chin curtain 62 is provided with another type of chin curtain connector that can be removably connected to a corresponding helmet connector disposed on the corresponding side of the helmet 10. The chin curtain and helmet connectors can be different parts of a snap fastener or hook and loop fasteners for example.

In the present embodiment, the chin curtain 62 defines three pockets 72 in each of the left and right upper corner portions of the chin curtain 62. The magnets 64 and 66 are each inserted in one of the pockets 72 on their respective side of the chin curtain 62. By having multiple pockets 72, the magnets 64, 66 can be placed at different locations to accommodate different sizes of helmets and/or different positions of the fasteners 28, 29 on the helmet. It is contemplated that there could be more or less than three pockets 72 in each corner portions of the chin curtain 62, including a single pocket 72 per side. It is also contemplated that pockets 72 could be provided on only one side of the chin curtain 62. It is contemplated that the magnets 64, 66 could be connected to the chin curtain 62 in other ways. For example, the magnets 64, 66 could be bonded or fastened to the chin curtain 62.

Figure 4:
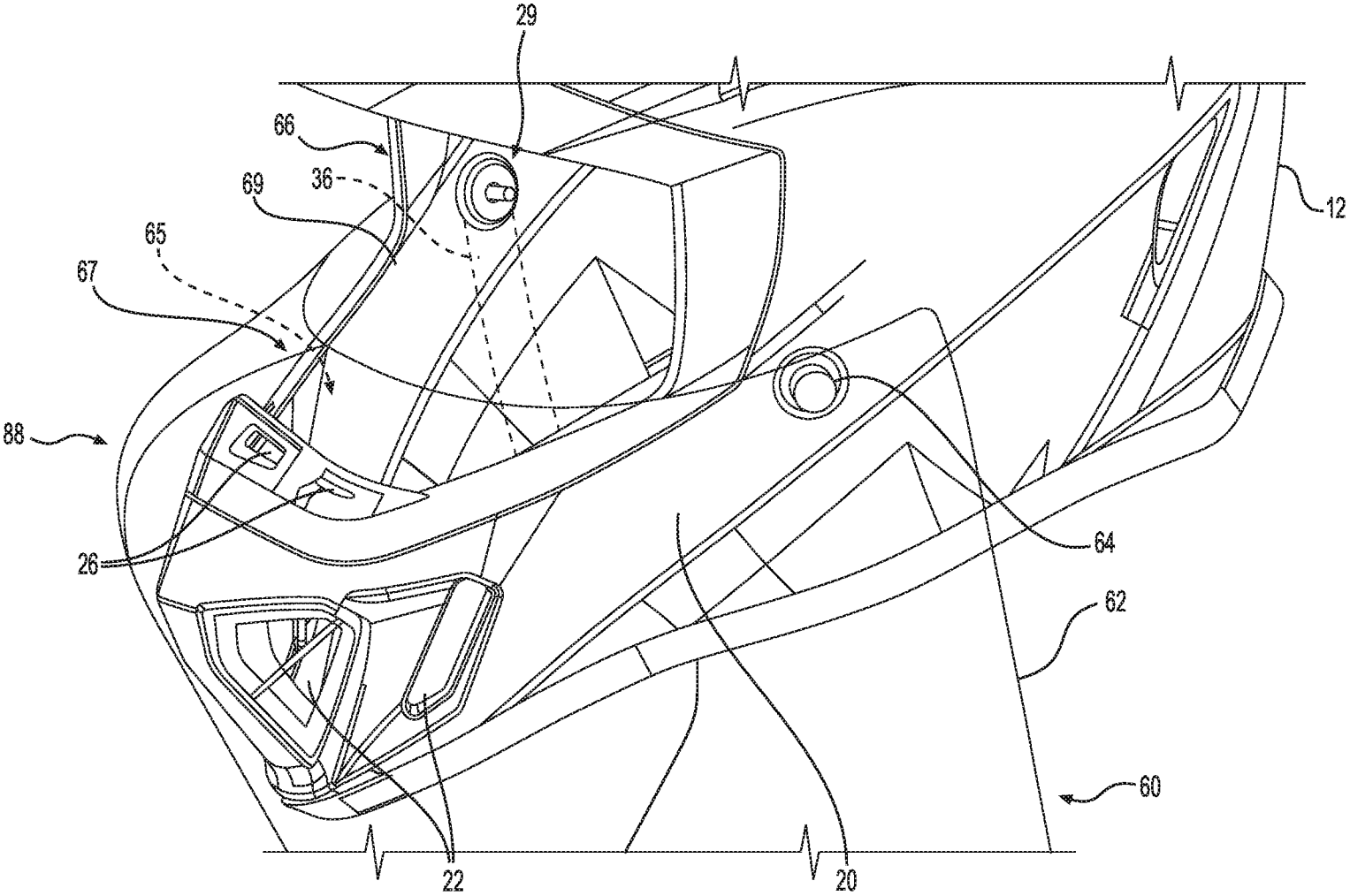
FIG. 4 is a perspective close up view of FIG. 3, in which the removable chin curtain is illustrated in translucency.
Figure 5:
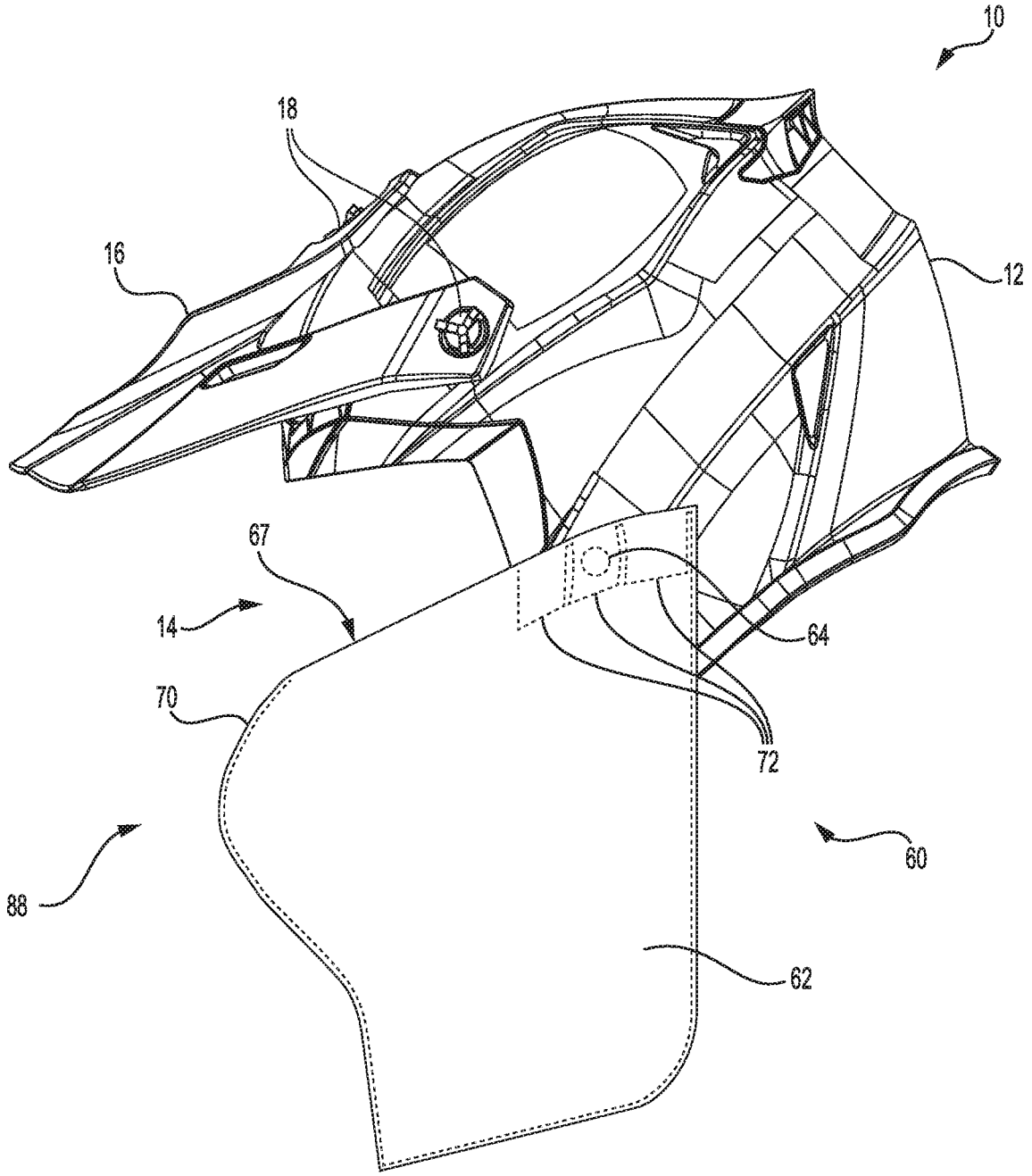
FIG. 5 is a left side elevation view of the elements of FIG. 3.
Figure 6:
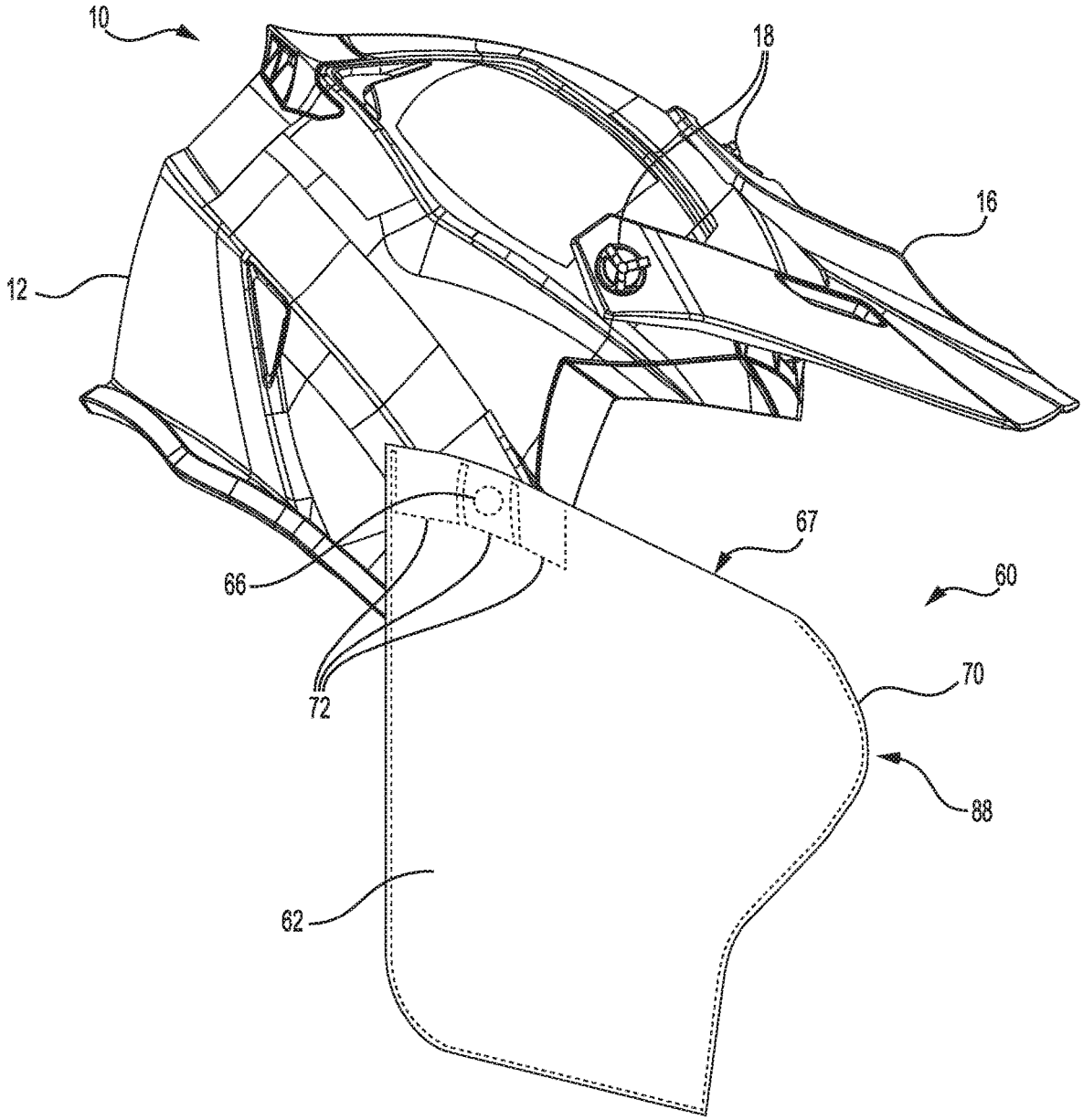
FIG. 6 is a right side elevation view of the elements of FIG. 3.
Figure 7A:
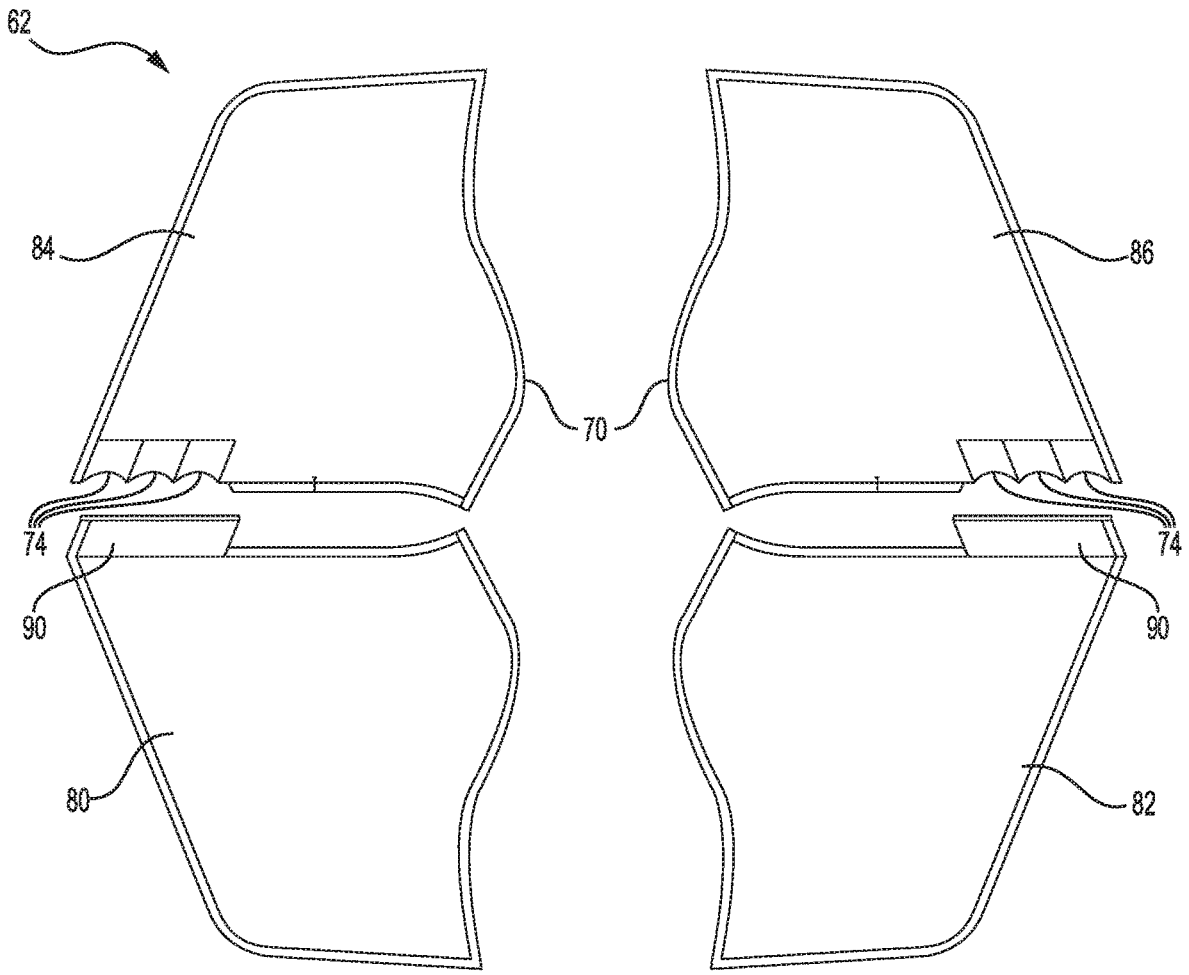
FIG. 7A is an exploded view of the chin curtain of FIG. 3.

As seen in FIG. 7A, the chin curtain 62 is made of four portions: a front right side portion 80, a front left side portion 82, a rear right side portion 84 and a rear left side portion 86. The front and rear right side portions 80, 84 are connected to each other, the front and rear left side portions 82, 86 are connected to each other, then the right side portions 80, 84 are connected to the left side portions 82, 86 along a seam 70. In the present embodiment, the portions 80, 82, 84, 86 are sewn to each other, but it is contemplated that they could be connected in other ways such as by bonding. As can be seen, the edges of the portions 80, 82, 84, 86 forming the seam 70 are arcuate. As such, the resulting seam 70 has an arcuate section. This arcuate section of the seam 70 defines a jaw shield receiving portion 88 of the chin curtain 62. The jaw shield 20 is received in part in the jaw shield receiving portion 88 when the chin curtain 62 is connected to the helmet 10 as can be seen in FIGS. 4 and 5 for example. The arcuate seam 70 helps to keep the upper portion 67 of the chin curtain 62 down flat. This helps prevent this portion 67 of the chin curtain 62 from interfering with the line of sight of the wearer. A straight seam could cause a loose fit above the U-shaped space 65, causing the upper portion of the chin curtain 67 to flap up and down, due at least in part to the permanent magnets 64, 66 being connected to the helmet 10 at a position lower than the upper portion 67 of the chin curtain 62. The upper rear edge 69 of the chin curtain 62 has a semi-circular shape such that, when connected to the helmet 10, from one of the permanent magnets 64, 66, the chin curtain 62 extends forward so as to pass in front of a face of the wearer of the helmet 10, and then extends rearward to the other one of the permanent magnets 64, 66. The arcuate seam 70 combined with the semi-circular upper rear edge 69 provides a tight fit around the jaw shield 20, even though the jaw shield 20 has the nose guard 24 connected to it that forms an upward projection. The arcuate seam 70 allows the front portion of the chin curtain 62 to follow the downwardly and inwardly slanting surface of the jaw shield 20 more closely compared to a straight seam. It is contemplated that the seam 70 could be straight, but this may result in the chin curtain 62 not fitting as well over the jaw shield 20 as explained above. It is contemplated that the chin curtain 62 could be made differently in alternative embodiments. For example, the chin curtain 62 could be made of one integral piece or of a single front portion connected to a single rear portion.

Each of the rear side portions 84, 86 have three areas 74 which form the pockets 72 when the rear side portions 84, 86 are connected to the front side portions 80, 82. Each of the front side portions 80, 82 has a flap 90 that is closed over the pockets 72 to close the open tops of the pockets 72 and prevent the magnets 64, 66 from falling out of the pockets 72.

Figure 7B:
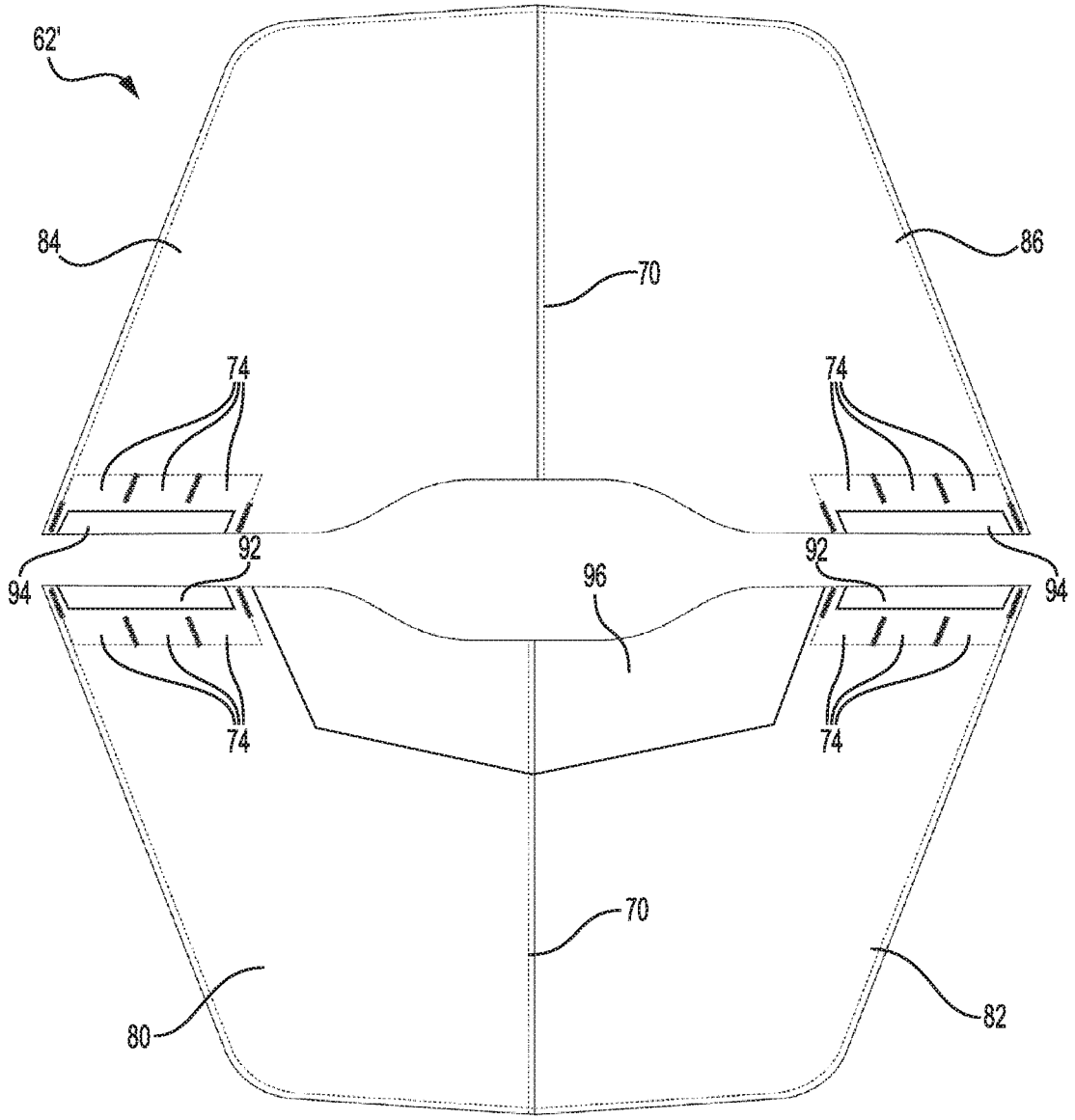
FIG. 7B is a partially exploded view of an alternative embodiment of the chin curtain of FIG. 3.

FIG. 7B illustrates a chin curtain 62' which is an alternative embodiment of the chin curtain 62. Elements of the chin curtain 62' that are similar to those of the chin curtain 62 retain the same reference numeral and will generally not be described again.

In FIG. 7B, the front right and left side portions 80, 82 are shown connected to each other and the rear right and left side portions 84, 86 are also shown connected to each other. Each portion 80, 82, 84, 86 has three areas 74 which, when all the portions 80, 82, 84, 86 are connected together, form three pockets 72 on the left side and three pockets 72 on the right side. In the chin curtain 62', instead of a flap 90 that is closed over the pockets 72, the top of the pockets 72 are closed by hook and loop fasteners. More specifically, bands of hook and loop fasteners are provided at the top of the areas 74. One of the hook side and the loop side (elements 92 in FIG. 7B) of the band of hook and loop fasteners is provided on each front side portions 80, 82, and another one of the hook side and the loop side (elements 94 in FIG. 7B) of the band of hook and loop fasteners is provided on each rear side portions 84, 86. The chin curtain 62' is also provided with a reinforcement yoke 96 at a top central part thereof that is bonded, stitched or otherwise connected to the front portions 80, 82. When all the portions 80, 82, 84, 86 are connected together, the reinforcement yoke 96 is disposed inside the chin curtain 62' between the front portions 80, 82 and the rear portions 84, 86. It is contemplated that reinforcement yoke 96 could alternatively be bonded, stitched or otherwise connected to the rear portions 84, 86. In one embodiment, the reinforcement yoke 96 is an additional piece of fabric of the same kind as the portions 80, 82, 84, 86, but other types of materials are contemplated. The reinforcement yoke 96 make the area of the chin curtain 62' where it is located more rigid such that the chin curtains 62' holds its shape better when connected to the helmet 10. It is contemplated that other embodiments of a chin curtain described herein could be provided with a reinforcement yoke 96.

Another embodiment of a helmet 100 to which the chin curtain assembly 60 can be connected will now be described with reference to FIG. 8. Elements of the helmet 100 that are similar to those of the helmet 10 retain the same reference numeral and will generally not be described again.

Figure 8:
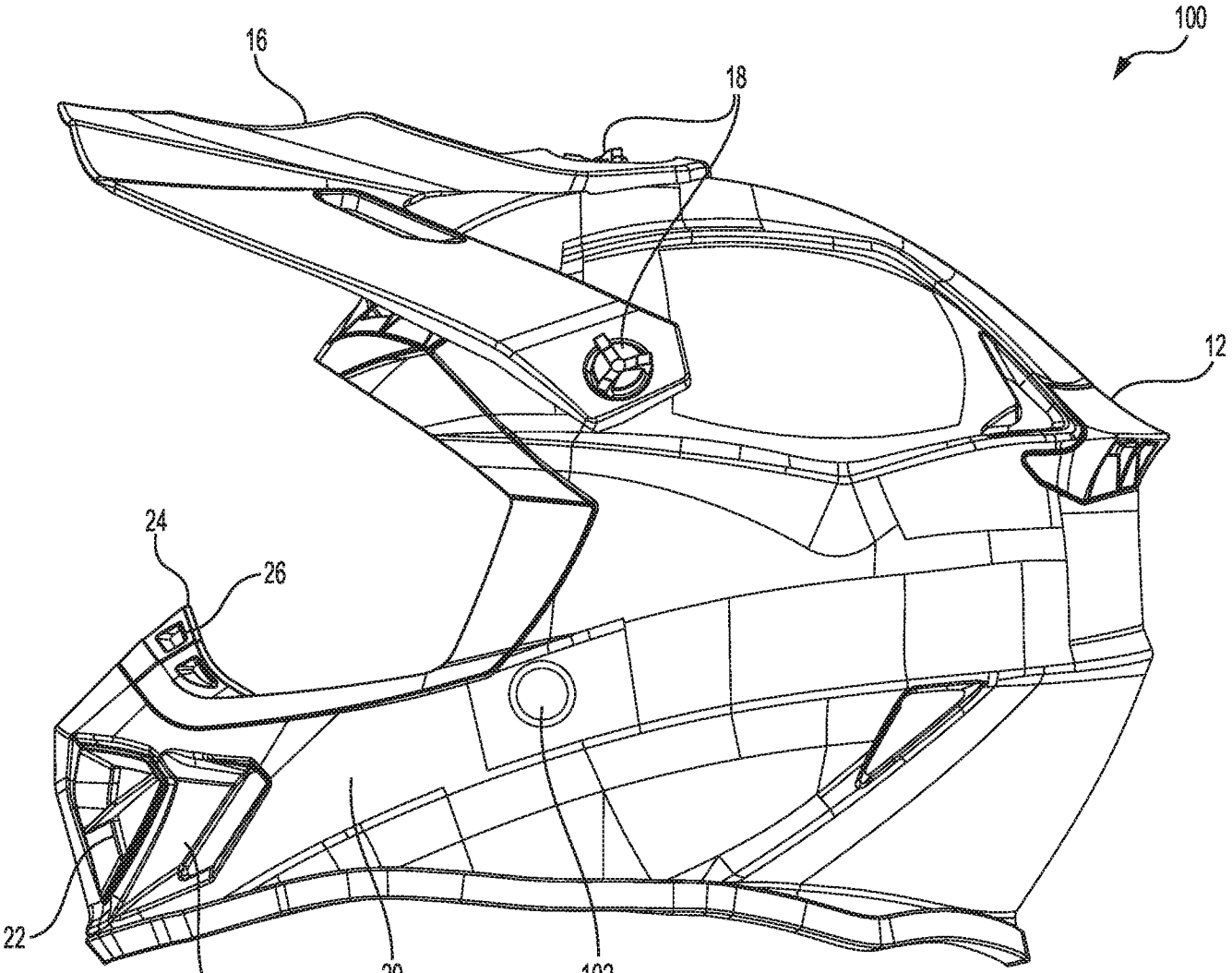
FIG. 8 is a left side elevation view of an alternative embodiment of the helmet of FIG. 1.

Instead of the fasteners 28, 29 being used to connect the chin curtain assembly 60 to the helmet 100, the helmet 100 is provided with two ferromagnetic connectors 102 connected on each side thereof (only a left one being shown in FIG. 8). The ferromagnetic connectors 102 in the present embodiment are circular steel plates, but other types of connectors 102 are contemplated. The ferromagnetic connectors 102 are adapted to selectively connect to the permanent magnets 64 and 66, in order to connect the chin curtain 62 to the helmet shell 12. In an alternative embodiment, the elements 102 provided on the helmet 100 are permanent magnets and the chin curtain assembly 60 has ferromagnetic connectors instead of the permanent magnets 64, 66. It is contemplated that the elements 102 could be bonded to the helmet 100. It is contemplated that the helmet 100 may not have been originally provided with the elements 102, that the elements 102 could be part of a kit with the chin curtain assembly 60, and that the elements 102 could then be disposed on the helmet 100 to permit the use of the chin curtain assembly 60.

Another embodiment of a helmet 120 and an alternative corresponding embodiment of a chin curtain assembly 130 will now be described with reference to FIGS. 9 and 10. Elements of the helmet 120 that are similar to those of the helmet 10 described above retain the same reference numeral and will generally not be described again.

Figure 9:
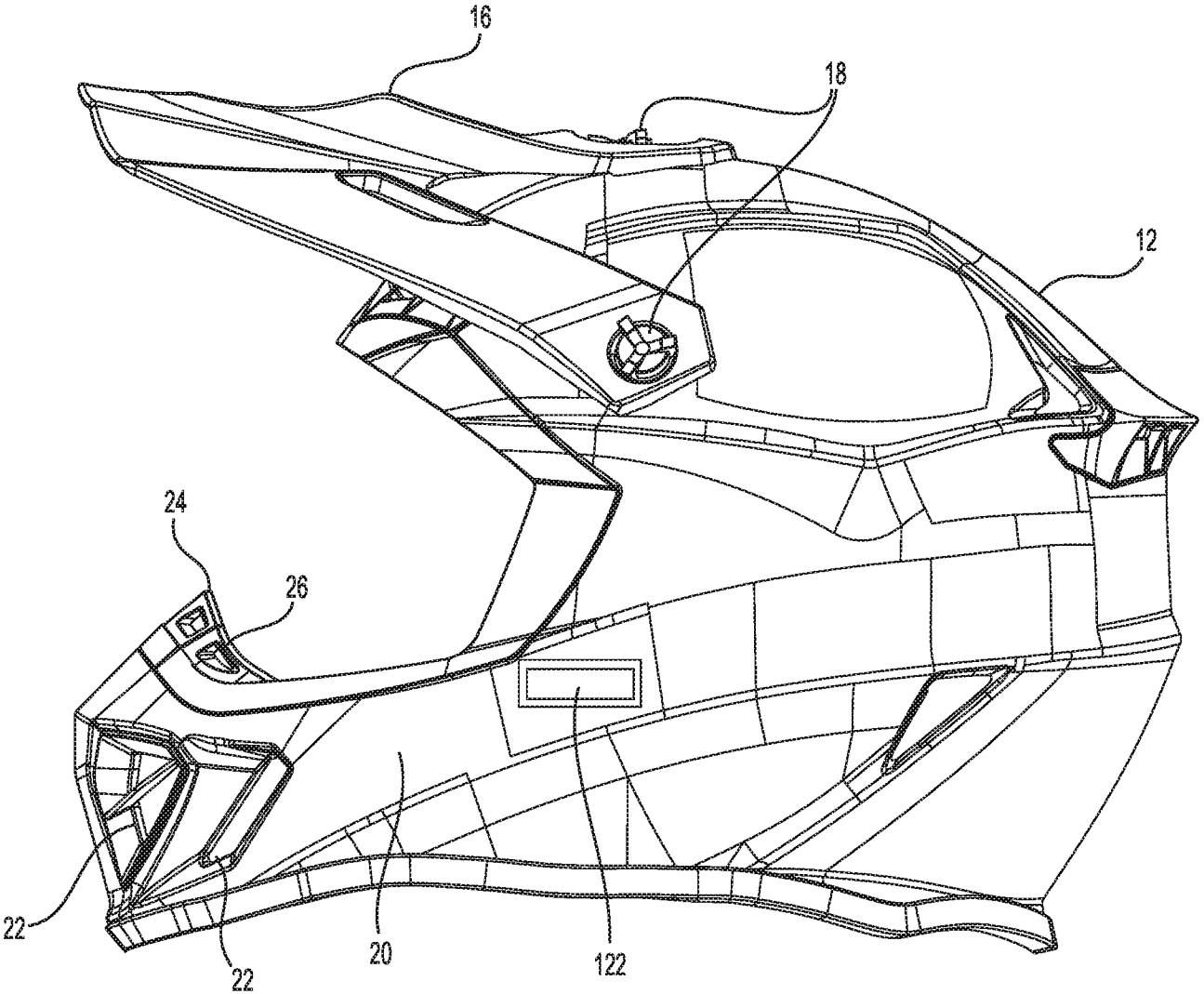
FIG. 9 is a left side elevation view of another alternative embodiment of the helmet of FIG. 1.
Figure 10:
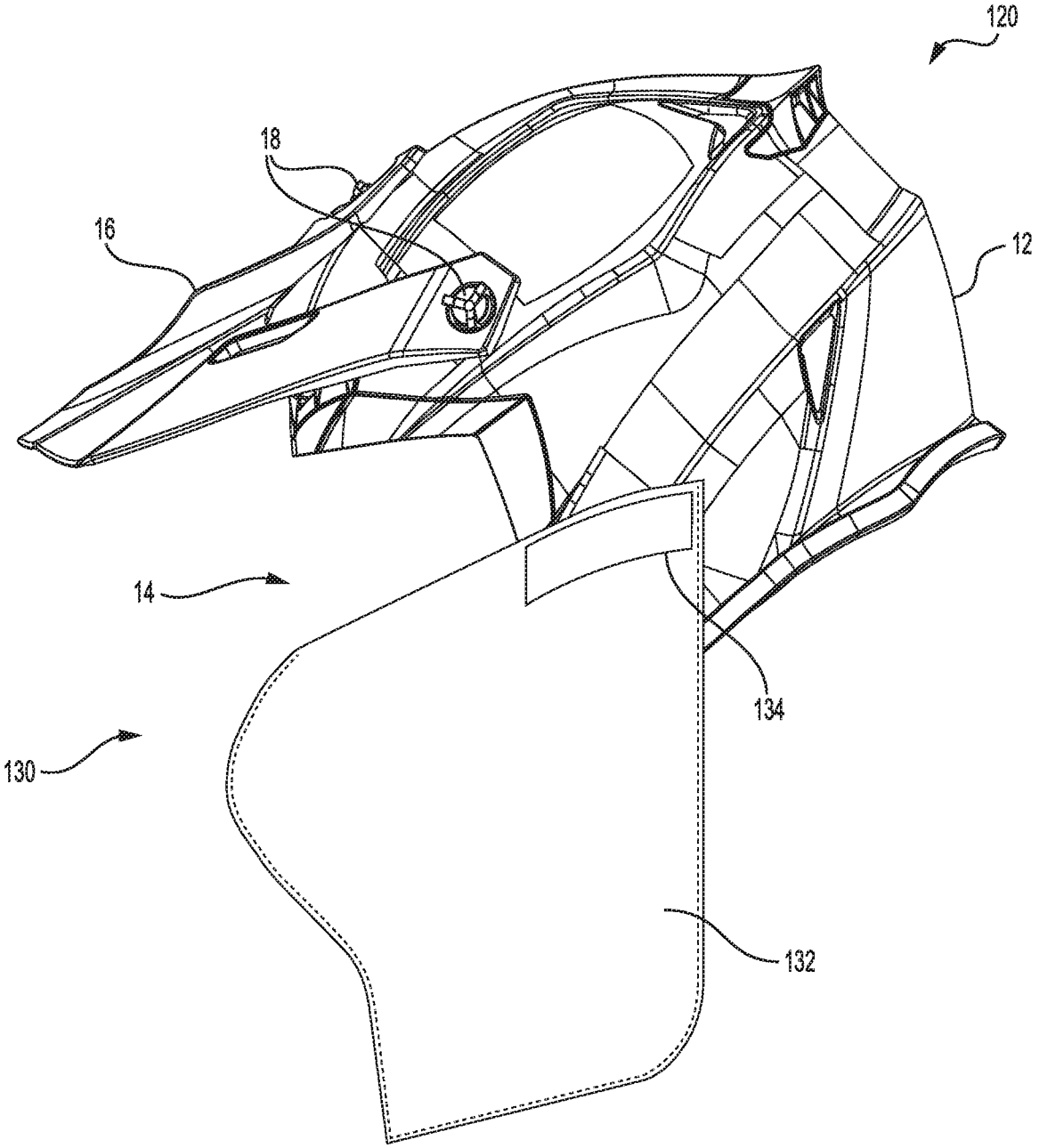
FIG. 10 is left side elevation view of the helmet of FIG. 9, with an alternative embodiment of the removable chin curtain assembly attached to the helmet.

Instead of the fasteners 28, 29 being used to connect the chin curtain assembly 130 to the helmet 120, the helmet 120 is provided with two helmet connectors 122 connected on each side thereof (only a left one being shown in FIG. 9). With reference to FIG. 10, the chin curtain assembly 130 has a chin curtain 132 and right and left side chin curtain connectors 134 connected to the right and left upper corner portions of the chin curtain 132 (only the left chin curtain connector 134 being shown in FIG. 10). The helmet connectors 122 are adapted for removably connecting to their corresponding chin curtain connectors 134, thereby removably connecting the chin curtain 132 to the helmet 120. In one embodiment, the connectors 122 and 134 are different parts of hook and loop fasteners. In another embodiment, the helmet connectors 122 are hooks and the chin curtain connectors 134 are elastic loops than can hook onto the hooks (or vice versa). In yet another embodiment, the connectors 122 and 134 are different parts of a snap fastener. It is contemplated that the connectors 122, 134 could be of another type that provides a removable connection not requiring the use of tools for connecting and disconnecting. As can be seen in FIG. 10, the chin curtain 132 covers the portions of the helmet 120 corresponding to those of the helmet 10 covered by the chin curtain 62.

Figure 11:
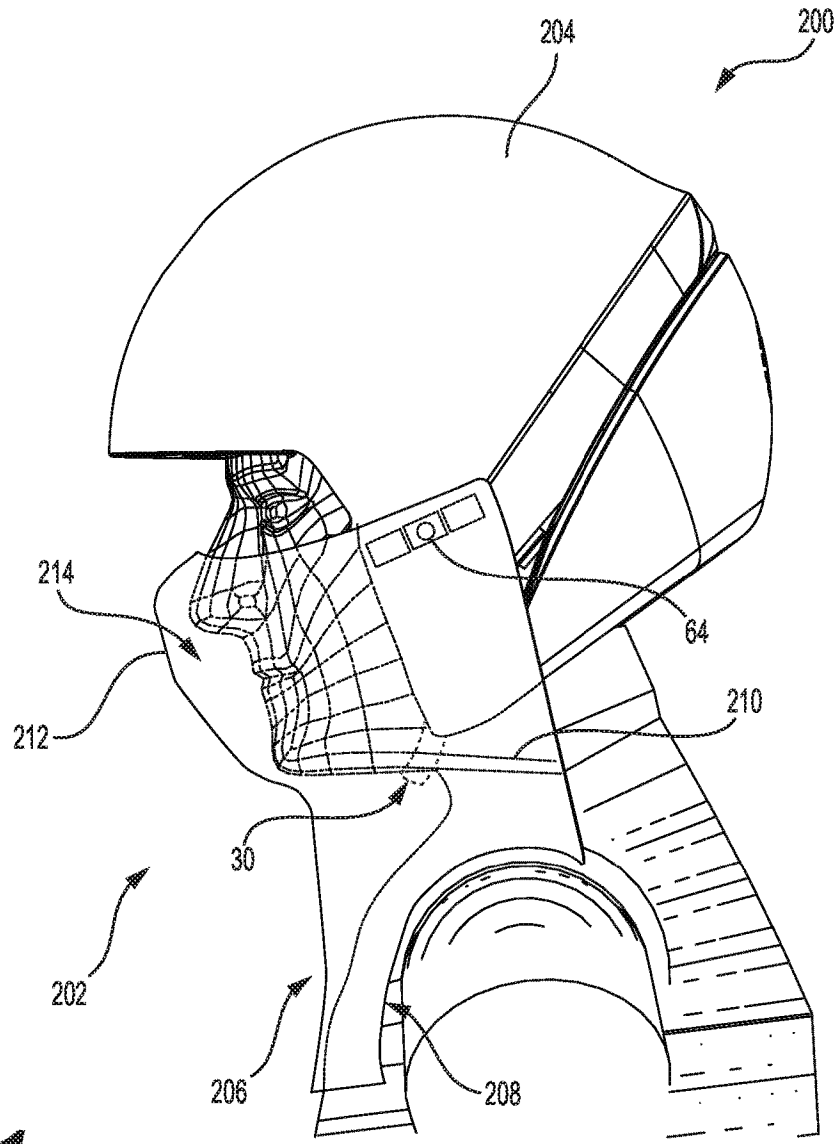
FIG. 11 is a left side elevation view of an alternative embodiment of the helmet of FIG. 1 worn by a user, with an alternative embodiment of the removable chin curtain assembly attached to the helmet.

Another embodiment of a helmet 200 and an another embodiment of a chin curtain assembly 202 will now be described with reference to FIG. 11. Elements of the helmet 200 and chin curtain assembly 202 that are similar to those of the helmet 10 and chin curtain assembly 60 described above retain the same reference numeral and will generally not be described again in detail.

The helmet 200 helmet shell 204 which, unlike the helmet shell 12 of the helmet 10, does not have a jaw shield connected to it. The helmet 200 also does not have a visor, but it is contemplated that a visor could be connected to the helmet shell 204. The chin strap 30 of the helmet 200 is connected to both sides of the helmet shell 204 by side fasteners (not shown, but similar to side fasteners 28, 29 described above).

The chin curtain assembly 202 has a chin curtain 206 and permanent magnets (only a left magnet 64 being shown). The permanent magnets are received in pockets 72 defined by the chin curtain 206 as in the chine curtain assembly 60 described above. The permanent magnets selectively magnetically connect the chin curtain 206 to the side fasteners of the helmet 200 in the same as the permanent magnets 64, 66 selectively magnetically connect the chin curtain 62 to the helmet 10, as described above. It is contemplated that the chin curtain 206 could be alternatively be connected to the helmet 200 according to any one of the embodiments described above with reference to FIGS. 1 to 10.

The chin curtain 206 is longer than the chin curtain 62 so as to extend further down on a chest of a person wearing the helmet 200. The lower edge of the chin curtain 206 defines two arcs 208 (only a left one being shown) for generally following a contour of the shoulders of a person wearing the helmet 200 when the chin curtain assembly 202 is attached to the helmet 200. Like the chin curtain 62, the chin curtain 206 is made of four portions: a front right side portion (not shown), a front left side portion 210, a rear right side portion (not shown) and a rear left side portion (not shown). The front and rear right side portions are connected to each other, the front and rear left side portions are connected to each other, then the right side portions are connected to the left side portions along a seam 212. As for the chin curtain 62, the edges of the portions forming the seam 212 are arcuate. As such, the resulting seam 212 has an arcuate section. This arcuate section forms an air chamber 214 in the region of the wearer's mouth and nose as can be seen in FIG. 11.

It is contemplated that the chin curtain assembly 60 could also be used with the helmet 200. As the chin curtain assembly 60 also has an arcuate seam 212, it would also form an air chamber in the region of the wearer's mouth. It is also contemplated that the chin curtain assembly 202 could be used with the helmet 10 as the arcuate seam 212 would permit the jaw shield 22 to be properly received in the chin curtain 206, as with the chin curtain 62.

Modifications and improvements to the above-described embodiments of the present invention may become apparent to those skilled in the art. The foregoing description is intended to be exemplary rather than limiting. The scope of the present invention is therefore intended to be limited solely by the appended claims.

What is claimed is:

1. A removable chin curtain assembly selectively attachable to a helmet, the helmet having:

a helmet shell for receiving a head of a wearer of the helmet, the helmet shell defining at least in part an aperture, the wearer of the helmet seeing through the aperture when wearing the helmet;

a chin strap connected to the helmet shell, the chin strap having a first chin strap portion and a second chin strap portion, the first chin strap portion being selectively connected to the second chin strap portion;

a first fastener connecting the first chin strap portion to the helmet shell on a first side of the helmet, the first fastener being made at least in part of ferromagnetic material; and a second fastener connecting the second chin strap portion to the helmet shell on a second side of the helmet, the second fastener being made at least in part of ferromagnetic material;

the removable chin curtain assembly comprising:

a chin curtain; and at least one permanent magnet connected to the chin curtain, the at least one permanent magnet being adapted for selectively magnetically connecting the chin curtain to at least one of the first and second fasteners, as a result of the chin curtain being magnetically connected to the at least one of the first and second fasteners, a first portion of the helmet shell being disposed between the first chin strap portion and the chin curtain, and a second portion of the helmet shell being disposed between the second chin strap portion and the chin curtain.

2. The removable chin curtain assembly of claim 1, wherein:

the helmet further has a jaw shield connected to helmet shell;

the helmet shell and the jaw shield define the aperture therebetween;

the first fastener fastens the first chin strap portion to one of the helmet shell and the jaw shield on the first side of the helmet;

the second fastener fastens the second chin strap portion to one of the helmet shell and the jaw shield on the second side of the helmet; and the chin curtain, when connected to the helmet by the at least one permanent magnet, covers at least in part the jaw shield and extends below the jaw shield.

3. The removable chin curtain assembly of claim 2, wherein:

the jaw shield defines at least one vent; and the chin curtain, when connected to the helmet by the at least one permanent magnet, covers the at least one vent defined in the jaw shield.

4. The removable chin curtain assembly of claim 2, wherein the chin curtain, when connected to the helmet by the at least one permanent magnet, extends over a top of the jaw shield to cover a generally U-shaped space defined by the jaw shield.

5. The removable chin curtain assembly of claim 1, wherein:

the at least one permanent magnet includes a first permanent magnet and a second permanent magnet;

the first permanent magnet being adapted for selectively magnetically connecting the chin curtain to the first fastener; and the second permanent magnet being adapted for selectively magnetically connecting the chin curtain to the second fastener.

6. The removable chin curtain assembly of claim 5, wherein:

the first and second permanent magnets are connected to first and second corner portions of the chin curtain; and the first and second corner portions are disposed on opposite sides of the chin curtain.

7. The removable chin curtain assembly of claim 1, wherein the chin curtain includes at least one pocket, the at least one permanent magnet being received in the at least one pocket.

8. The removable chin curtain assembly of claim 7, wherein:

the at least one permanent magnet includes a first permanent magnet and a second permanent magnet;

the first permanent magnet being adapted for selectively magnetically connecting the chin curtain to the first fastener; and the second permanent magnet being adapted for selectively magnetically connecting the chin curtain to the second fastener;

the at least one pocket includes a first plurality of pockets on a first side of the chin curtain and a second plurality of pockets on a second side of the chin curtain;

the first permanent magnet is received in one pocket of the first plurality of pockets; and the second permanent magnet is received in one pocket of the second plurality of pockets.

9. The removable chin curtain assembly of claim 1, wherein the chin curtain is made from flexible material.

10. The removable chin curtain assembly of claim 9, wherein the flexible material is at least one of:

polyester fabric; and nylon coated with polyurethane.

11. The removable chin curtain assembly of claim 1, wherein:

the chin curtain includes a first side portion and a second side portion; and the first side portion is connected to the second side portion along a seam.

12. The removable chin curtain assembly of claim 11, wherein:

the helmet further has a jaw shield connected to helmet shell;

the helmet shell and the jaw shield define the aperture therebetween; and the seam has an arcuate section defining a jaw shield receiving portion of the chin curtain, the jaw shield being received at least in part in the jaw shield receiving portion when the chin curtain is connected to the helmet by the at least one permanent magnet.

13. The removable chin curtain assembly of claim 1, wherein:

the first chin strap portion has a first end and a second end, the first end of the first chin strap portion being connected to the helmet shell by the first fastener;

the second chin strap portion has a first end and a second end, the first end of the second chin strap portion being connected to the helmet shell by the second fastener; and the second end of the first chin strap portion is selectively connected to the second end of the second chin strap portion by a connector.

14. The removable chin curtain assembly of claim 1, wherein:

the first chin strap portion is connected to the first fastener inside the helmet shell;

the second chin strap portion is connected to the second fastener inside the helmet shell; and the at least one permanent magnet is adapted for selectively magnetically connecting the chin curtain to the at least one of the first and second fasteners outside of the helmet shell.

15. A removable chin curtain assembly selectively attachable to a helmet, the helmet having:

a helmet shell for receiving a head of a wearer of the helmet;

the helmet shell defining at least in part an aperture, the wearer of the helmet seeing through the aperture when wearing the helmet;

a jaw shield connected to the helmet shell, the helmet shell and the jaw shield defining the aperture therebetween;

one of a first ferromagnetic connector and a first permanent magnet connected to a first side of the helmet; and one of a second ferromagnetic connector and a second permanent magnet connected to a second side of the helmet;

the removable chin curtain assembly comprising:

a chin curtain;

an other one of the first ferromagnetic connector and the first permanent magnet connected to the chin curtain, the other one of the first ferromagnetic connector and the first permanent magnet being adapted for selectively magnetically connecting the chin curtain to the one of the first ferromagnetic connector and the first permanent magnet; and an other one of the second ferromagnetic connector and the second permanent magnet connected to the chin curtain, the other one of the second ferromagnetic connector and the second permanent magnet being adapted for selectively magnetically connecting the chin curtain to the one of the second ferromagnetic connector and the second permanent magnet, the chin curtain, when connected to the helmet, covering at least in part the jaw shield, extending below the jaw shield, and extending over the jaw shield to cover a generally U-shaped space defined by the jaw shield.

16. The removable chin curtain assembly of claim 15, wherein:

the jaw shield defines at least one vent; and the chin curtain, when connected to the helmet by the at least one permanent magnet, covers the at least one vent defined in the jaw shield.

17. The removable chin curtain assembly of claim 15, wherein:

the other one of the first ferromagnetic connector and the first permanent magnet is the first permanent magnet; and the other one of the second ferromagnetic connector and the second permanent magnet is the second permanent magnet.

18. The removable chin curtain assembly of claim 17, wherein:

the first and second permanent magnets are connected to first and second corner portions of the chin curtain; and the first and second corner portions are disposed on opposite sides of the chin curtain.

19. The removable chin curtain assembly of claim 15, wherein the chin curtain is made from flexible material.

20. The removable chin curtain assembly of claim 19, wherein the flexible material is at least one of:

polyester fabric; and nylon coated with polyurethane.

21. The removable chin curtain assembly of claim 15, wherein:

the chin curtain includes a first side portion and a second side portion; and the first side portion is connected to the second side portion along a seam.

22. A removable chin curtain assembly selectively attachable to a helmet, the helmet having:

a helmet shell for receiving a head of a wearer of the helmet;

the helmet shell defining at least in part an aperture, the wearer of the helmet seeing through the aperture when wearing the helmet;

a first ferromagnetic connector connected to a first side of the helmet; and a second ferromagnetic connector connected to a second side of the helmet;

the removable chin curtain assembly comprising:

a chin curtain;

a first permanent magnet connected to the chin curtain, the first permanent magnet being adapted for selectively magnetically connecting the chin curtain to the first ferromagnetic connector; and a second permanent magnet connected to the chin curtain, the second permanent magnet being adapted for selectively magnetically connecting the chin curtain to the second ferromagnetic connector, the chin curtain including a first plurality of pockets on a first side of the chin curtain and a second plurality of pockets on a second side of the chin curtain, the first permanent magnet being received in one pocket of the first plurality of pockets, each pocket of the first plurality of pockets being configured for receiving the first permanent magnet therein such that the first permanent magnet is movable from the one pocket of the first plurality of pockets to another pocket of the first plurality of pockets; and the second permanent magnet being received in one pocket of the second plurality of pockets, each pocket of the second plurality of pockets being configured for receiving the second permanent magnet therein such that the second permanent magnet is movable from the one pocket of the second plurality of pockets to another pocket of the second plurality of pockets.

23. A removable chin curtain assembly selectively attachable to a helmet, the helmet having:

a helmet shell for receiving a head of a wearer of the helmet;

the helmet shell defining at least in part an aperture, the wearer of the helmet seeing through the aperture when wearing the helmet;

one of a first ferromagnetic connector and a first permanent magnet connected to a first side of the helmet; and one of a second ferromagnetic connector and a second permanent magnet connected to a second side of the helmet;

the removable chin curtain assembly comprising:

a chin curtain;

an other one of the first ferromagnetic connector and the first permanent magnet connected to the chin curtain, the other one of the first ferromagnetic connector and the first permanent magnet being adapted for selectively magnetically connecting the chin curtain to the one of the first ferromagnetic connector and the first permanent magnet; and an other one of the second ferromagnetic connector and the second permanent magnet connected to the chin curtain, the other one of the second ferromagnetic connector and the second permanent magnet being adapted for selectively magnetically connecting the chin curtain to the one of the second ferromagnetic connector and the second permanent magnet, the chin curtain including a first side portion and a second side portion, the first side portion being connected to the second side portion along a seam;

the helmet further comprising a jaw shield connected to helmet shell;

the helmet shell and the jaw shield defining the aperture therebetween; and the seam having an arcuate section defining a jaw shield receiving portion of the chin curtain, the jaw shield being received at least in part in the jaw shield receiving portion when the chin curtain is connected to the helmet by the at least one permanent magnet.

24. A removable chin curtain assembly selectively attachable to a helmet, the helmet having:

a helmet shell for receiving a head of a wearer of the helmet, the helmet shell defining at least in part an aperture, the wearer of the helmet seeing through the aperture when wearing the helmet;

a jaw shield connected to the helmet shell, the helmet shell and the jaw shield defining the aperture therebetween;

a first helmet connector connected to a first side of the helmet; and a second helmet connector connected to a second side of the helmet;

the removable chin curtain assembly comprising:

a chin curtain;

a first chin curtain connector connected to the chin curtain, the first chin curtain connector being adapted for selectively connecting the chin curtain to the first helmet connector; and a second chin curtain connector connected to the chin curtain, the second chin curtain connector being adapted for selectively connecting the chin curtain to the second helmet connector, the chin curtain, when connected to the helmet, covering at least in part the jaw shield, extending below the jaw shield, and extending over the jaw shield to cover a generally U-shaped space defined by the jaw shield.

* * * * *